United States Patent [19]

Brugman

[11] 4,137,045

[45] Jan. 30, 1979

[54] METHOD FOR TREATING A TEXTILE WEB WITH STEAM

[75] Inventor: Hans Brugman, Deldenbroek, Netherlands

[73] Assignee: Brugman Machinefabriek B.V., Netherlands

[21] Appl. No.: 782,009

[22] Filed: Mar. 28, 1977

Related U.S. Application Data

[63] Continuation of Ser. No. 612,048, Sep. 10, 1975, abandoned.

[30] Foreign Application Priority Data

Sep. 13, 1974 [NL] Netherlands ..... 7412216

[51] Int. Cl.[2] ..... D06B 5/08; D06B 21/02

[52] U.S. Cl. ..... 8/149.1; 8/149.3; 68/5 D; 68/18 C; 68/181 R

[58] Field of Search ..... 68/35 S, 5 B, 5 D, 5 E, 68/18 R, 18 C, 20, 62, 200, 205 R, 175, 181 R, 5 R, 5 A, 6; 34/23, 160, 16, 34; 239/597; 19/66 T; 118/62, 63; 15/306 A, 354; 134/64 R, 64 P, 122 R, 122 P; 8/149.1, 149.2, 149.3, 151

[56] References Cited

U.S. PATENT DOCUMENTS

| | | | |
|---|---|---|---|
| 3,574,261 | 4/1971 | Bailey | 68/20 X |
| 3,605,185 | 9/1971 | Kyle | 8/149.2 X |
| 3,782,899 | 1/1974 | Crosby | 8/149.2 |

*Primary Examiner*—Philip R. Coe

*Attorney, Agent, or Firm*—Ostrolenk, Faber, Gerb & Soffen

[57] ABSTRACT

A method for treating a textile web is disclosed. The method comprises the steps of passing a textile web over a slit formed in an elongated nozzle and in firm contact with the nozzle and simultaneously passing steam through said slit and towards said web at a speed approximately equal to the speed of sound.

6 Claims, 5 Drawing Figures

METHOD FOR TREATING A TEXTILE WEB WITH STEAM

RELATED APPLICATIONS

This is a continuation of application Ser. No. 612,048, filed Sept. 10, 1975, and now abandoned.

BACKGROUND OF THE INVENTION

My invention relates to an apparatus and method for treating a textile web, for example drying, cleaning and/or equalizing such a web. Known apparatus for carrying out methods of this type include driving members for supplying and discharging the web and means located between the driving members for performing the desired treatment. One such apparatus includes press equipment for drying a rinsing bath for cleaning and an immersion bath for impregnation of a desired liquid.

SUMMARY OF THE INVENTION

My invention aims to enable a plurality of widely divergent treatments to be performed on a textile web. The treatment means consists of a nozzle, oriented transversely to the direction of advance of the web, said nozzle being provided with a narrow slit or with holes, and it is positioned in such a manner that the driving members urge the web against it. Within the nozzle there is a treatment medium supplied under an overpressure causing this medium to issue from the nozzle and flow through the web at about the speed of sound.

In accordance with the foregoing, the method of the present invention comprises the steps of passing a textile web over a slit formed in an elongated nozzle and in firm contact with said nozzle and simultaneously passing a fluid through said slit towards said web at a speed approximately equal to the speed of sound.

It has been found that due to the very high trasversing velocity of the medium (gas, steam or liquid) a very intense effect on the fibers or filaments of the textile web is obtained. In this connection it should be noted that the expression "textile web" covers a fabric, knitwear, a fleece, a yarn package etc. The invention appears to be particularly effective for drying a web that has been treated in a liquid. The rollers of the press equipment usually required for this drying operation should exert considerable pressure and this may cause mechanical complications. This pressuring equipment can be omitted, whilst the web is better dried than on the average was possible with such an equipment. The treatment according to the invention is moreover very uniform in the transverse direction of the band without particular measures being required therefor.

For other wet treatment machines which are used for bleaching, soaping, finishing, mercerizing, dyeing etc. a treatment with the nozzle according to the invention also produces a noticeable improvement, since all kinds of superfluous particles in between the fibers are removed due to the invention, causing the web to be in a considerably better condition for any further treatment.

My invention also relates to a method for treating a textile web with a gaseous or liquid medium. This method is distinguished in that the medium is pressed under overpressure through a slitshaped nozzle so that the medium issues at a speed identical to or at approximately the speed of sound; the web to be treated is advanced while it is in firm contact with the nozzle. The pressure at which the treatment medium is supplied within the nozzle should be tuned to the dimensions of the slit such that the desired outflow velocity is achieved. Shock waves in the outflowing medium can often have a favourable effect, since the transfer energy to the particles to be removed from the web is increased and the result of the treatment is improved. The latter circumstance is particularly of importance when the method is performed for cleaning a textile web or, in the case when the web has been treated with or passed through a paint bath, for removing surplus paint remaining between the fibers or filaments of a previous paint bath.

The present utilised apparatus and method can favourably influence the homogeneity of the paint applied during a paint bath.

SURVEY OF THE DRAWINGS

DESCRIPTION OF A PREFERRED EMBODIMENT

Figure 1:
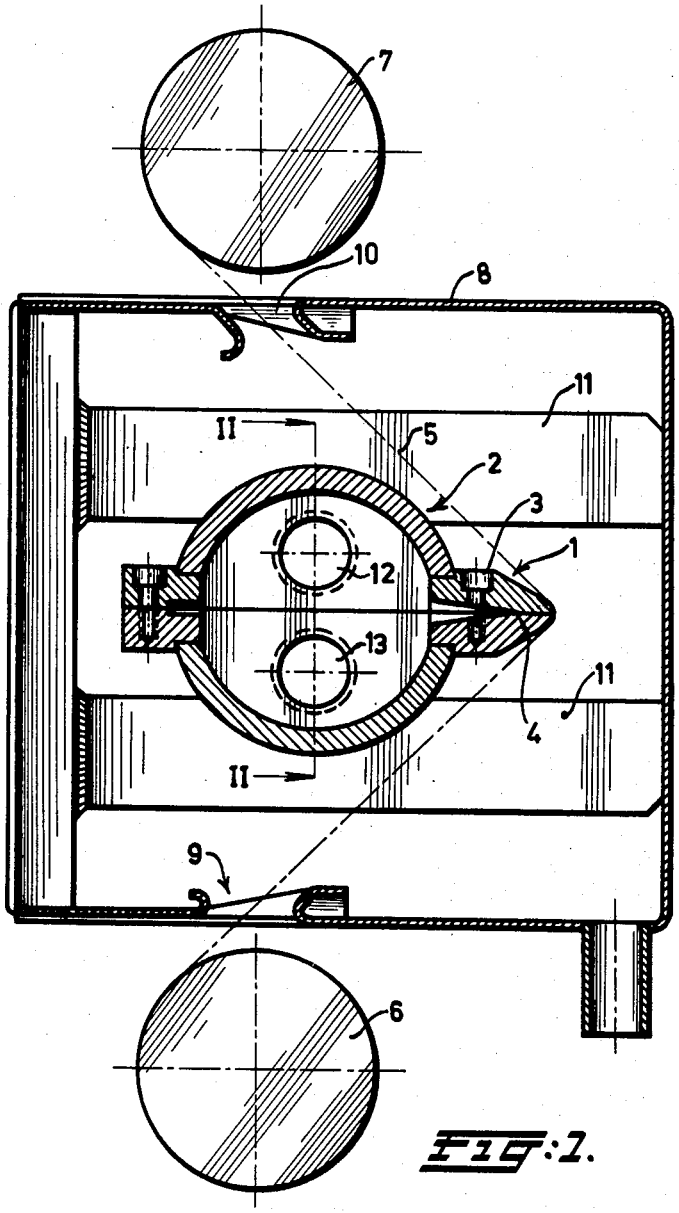
FIG. 1 shows a cross section through a first embodiment of the apparatus.
Figure 3:
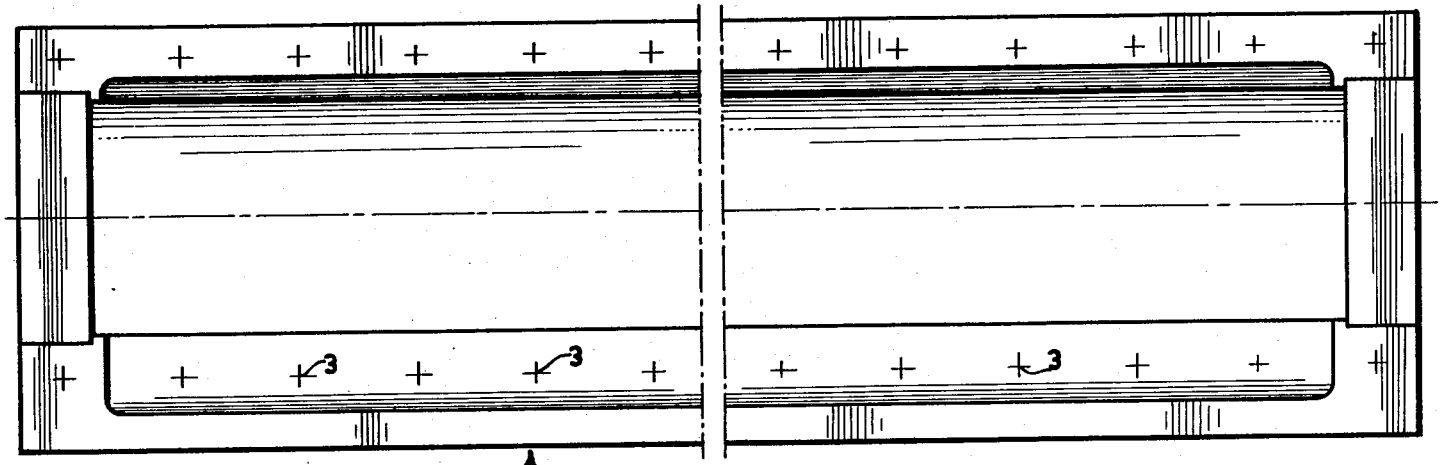
FIG. 3 is a plan view of the lower half of the mouth piece with accessories from FIG. 1.
Figure 2:
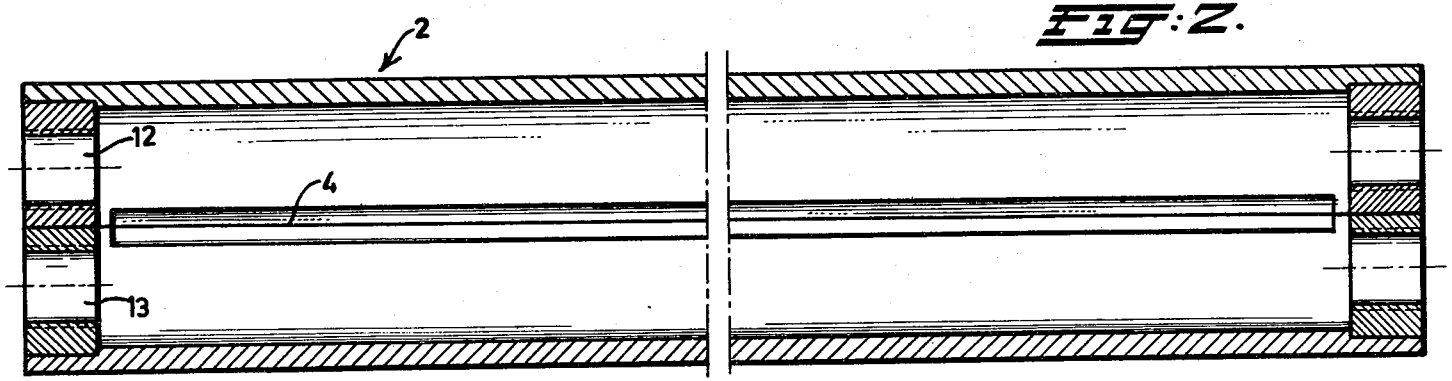
FIG. 2 is a section on the line II—II in FIG. 1.

As seen in FIGS. 1 and 2 the apparatus consists of a nozzle 1 secured to a pipe 2. Both the nozzle and the pipe consist of two mirror image symmetrical parts, which are clamped to each other by means of a plurality of fastening bolts 3. The location and number of bolts 3 are diagrammatically shown in FIG. 3. The nozzle 1 is provided with a narrow slit 4 the width of which ranges from 0.05 to 0.01 mm. This slit width can be adjusted by the placement of a gasket (of yellow brass or aluminium foil) between the two halves of the pipe 2. This gasket, not represented in the drawing, is between the two halves (see FIG. 3), so that the slit 4 remains clear throughout its length and the width of the slit is thus not reduced to zero at any point along its length. In order to obtain the required high velocity of the treatment medium (steam) issuing through the slit, the invention aims to reach an hydraulic diameter, i.e. the ratio length/width of the slit of about 100. The length of the slit is its dimension in the direction of flow.

The web 5 to be treated is conveyed over the driving members 6 and 7 and passes, thus, at the correct tightness over the nozzle 1. Further there is a casing 8 with an inlet 9 and an outlet 10 for the web 5. The pipe 2 is held in place within the casing 8 by means of a plurality of clamping strips 11. At one end or both ends of the pipe 2, openings 12 and 13 are provided for the supply of the treatment medium, and for the discharge of the eventually condensed liquid. As is clearly to be seen in FIG. 1 the tip of nozzle 1 is rounded. This nozzle is further wedge-shaped and encloses an angle of about 60°.

The operation of the apparatus described hereinbefore is as follows:

Via opening(s) 12 steam is, for example, supplied to pipe 2, thus causing a pressure to be maintained within the pipe. This pressure is such that in slit 4 flow of medium at the speed of sound is achieved. This pressure ranges mostly from 3 to 5 atmospheres and is naturally connected with the kind of medium, the length and the width of the slit 4 and the surface property of the slit owing to which a laminar of turbulent passage flow is effected. The speed at which the web 5 passes the nozzle 1 depends on the thickness of this web and on the effect of the outflowing medium jet on the web. Good results are achieved with speeds of about 10 to 55 meters per minute. It has been found that with the present apparatus a web issuing from a wet-treatment machine can be dried much better when steam is blown through than in case of the conventional press.

Figure 4:
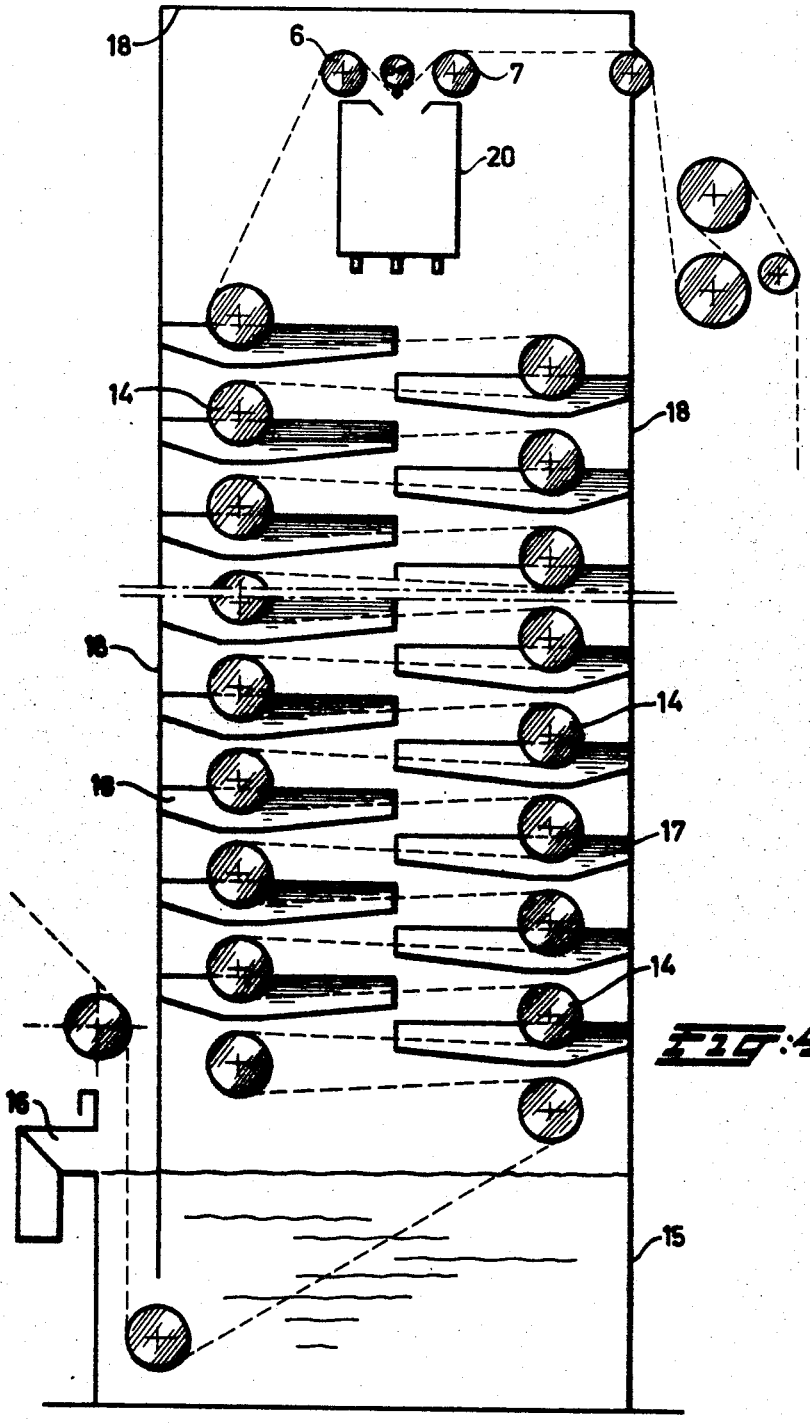
FIG. 4 shows a diagrammatical vertical section through a washing machine provided with an apparatus according to the invention.
Figure 5:
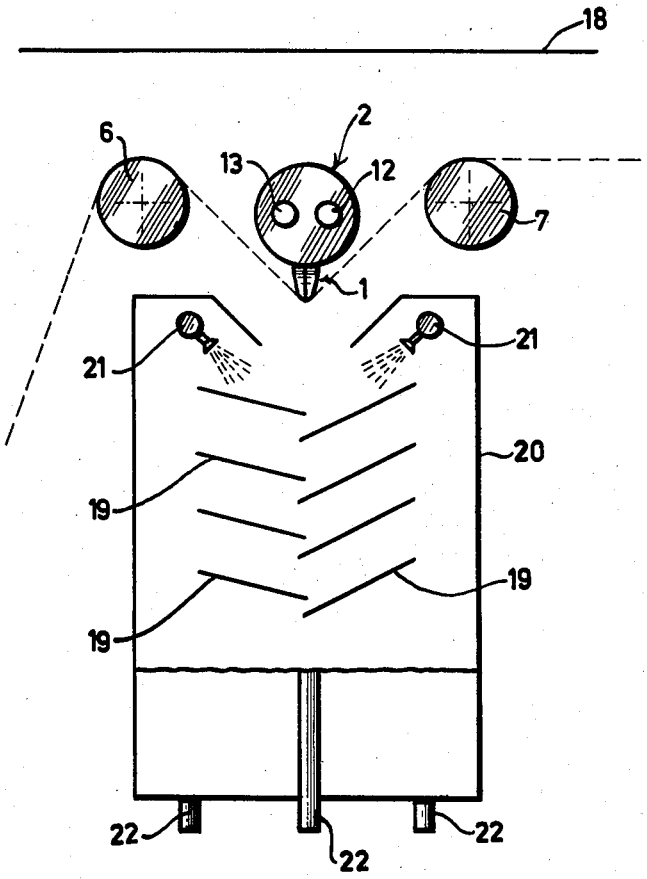
FIG. 5 shows on a larger scale a detail of FIG. 4.

FIGS. 4 and 5 show a rather interesting possibility for the application of the described apparatus. In this embodiment a plurality of parallel and horizontally arranged rollers 14 are provided which guide web 5 in a zigzag path through a trough 15 and through casing 18 above trough 15. Trough 15 contains a treatment liquid, the level of which is kept constant by means of an overflow outlet 16. In the broad-washing machine according to FIG. 4 two rows of having fifteen rollers 14 each are present. Underneath each roller a receptacle 17 is disposed with some outflow apertures in the lowest part thereof. The trough 15 merges in an upward direction into a casing 18 with an upper open space in which the particular treatment apparatus according to the invention is accommodated.

This treatment apparatus of FIG. 4 is shown in FIG. 5 on a larger scale. In FIG. 5, the web 5 is moved via the driving means 6,7 between which nozzle 1 and pipe 2 are disposed. The nozzle 1 is downwardly directed so that the steam jet issuing from the slit 4 moves downwards together with the particles removed from web 5 (e.g. liquid); the jet can then contact a number of baffle plates 19 which are secured in a trough 20.

Two spray pipes 21 are mounted above the baffle plates 19 for wetting these plates. Thus, condensation of the used steam is stimulated.

The water gathers at the bottom of trough 20 and can escape, via some standpipes 22, to casing 18.

The steam recovery device 19–22 described in the foregoing serves to utilize the heat still present in the steam consumed, for heating water to be supplied to the washing machine situated under this device. Some particular operative circumstances cause the water supplied to the spraying members 21 to have a temperature ranging from 60° to 65° C. While flowing over the plates 19, the water temperature is raised due to the condensation of steam and is brought up to 95° to 99° in the lower part of the trough 20.

The treatment as described hereinbefore can be performed on various materials, for instance on non-woven products such as fleeces. In that case it may be useful to have an auxiliary belt travel along on the back side of the web 5 in the area of nozzle 1 in order to ensure that the web 5 is pressed firmly against said nozzle. When treating a fabric or knitwear, pressing can be achieved by the pull in the web itself.

The method according to my invention cannot only be performed for drying a web of material, but also for heating, moistening, and impregnating said web as well as for equalizing after a prior treatment like dyeing. Especially in dyeing of textile web webs, difficulties are experienced in that dye particles gather in the spaces between the fibers or filaments of the textile material. The apparatus according to my invention removes (and sometimes recovers) these surplus dye particles, owing to which the finished article is dyed more effectively and tenably, than without the aforementioned treatment.

When a supporting belt as indicated hereinbefore is used, either a permeable or an impermeable belt can be utilised. The result in the latter case is that the medium does not go straight through web 5 but that it escapes in the longitudinal directions on either side of the nozzle 1. For that purpose the angle formed by web 5 with nozzle 1 is preferably greater than the wedge angle of the nozzle itself. In FIG. 1 these angles are from 60° to 90° and 60°, respectively.

In order to decrease any friction, the rounded tip of nozzle 1 can get a covering of plastic like TEFLON. Such a covering may also be of importance when the liquid in which the web has been treated, has a corrosive effect on metal.

Within the scope of my invention the web 5 may be treated by means of two or more nozzles arranged in parallel or in series. This is done when it is, for example, desirable to adapt the apparatus to the treatment of webs with various widths.

What I claim is:

1. A method for treating a textile web with a fluid medium, said method comprising the steps of passing a textile web over a slit formed in an elongated nozzle and in firm contact with said nozzle and simultaneously passing steam through said slit towards said web at a speed approximately equal to the speed of sound.

2. The method of claim 1 further including the steps collecting said steam in the form of a condensate after said steam passes through said web and washing said web with said condensate before said web passes over said nozzle.

3. The method of claim 1 wherein said web is passed over said slit at a speed of 10 to 55 meters per minute.

4. The method of claim 1 wherein said nozzle is coupled to a pressure chamber and wherein said method includes the step of passing said fluid medium through said chamber under sufficient pressure to cause said fluid medium to pass through said slit at a speed approximately equal to the speed of sound.

5. A method for removing particles from a textile web comprising the steps of:

passing said textile web over a slit formed in an elongated nozzle and in firm contact with said nozzle; and simultaneously passing steam through said slit towards said web at a speed approximately equal to the speed of sound whereby said steam passes through said web and carries with it particles originally located on said web.

6. The method of claim 5, further including the step of passing said web through a trough containing a liquid with which said web is to be treated prior to the step of passing said web over said slit in said nozzle.

* * * * *